US006226809B1

(12) United States Patent
Davies

(10) Patent No.: US 6,226,809 B1
(45) Date of Patent: May 8, 2001

(54) HYDRAULIC LIFT CYLINDER ASSEMBLIES

(75) Inventor: Anthony Roger Davies, Cirencester (GB)

(73) Assignee: Smith Industries Public Limited Company, London (GB)

( * ) Notice: Subject to any disclaimer, the term of this patent is extended or adjusted under 35 U.S.C. 154(b) by 0 days.

(21) Appl. No.: 09/301,073

(22) Filed: Apr. 28, 1999

(30) Foreign Application Priority Data

May 12, 1998 (GB) ..... 9810113

(51) Int. Cl.[7] ..... A47K 3/02
(52) U.S. Cl. ..... 4/563.1; 4/560.1; 92/29
(58) Field of Search ..... 4/496, 560.1, 561.1, 4/562.1, 563.1; 5/83.1, 87.1; 92/2, 29; 414/921

(56) References Cited

U.S. PATENT DOCUMENTS

| | | | | |
|---|---|---|---|---|
| 2,725,093 | * | 11/1955 | Saelen | 4/563.1 X |
| 3,078,473 | * | 2/1963 | Daniels | 4/563.1 |
| 3,381,317 | * | 5/1968 | Daniels et al. | 4/563.1 |
| 3,815,163 | | 6/1974 | Sullivan | 4/563.1 |
| 4,075,719 | | 2/1978 | Sullivan | 4/563.1 |
| 5,465,433 | | 11/1995 | Nolan | 4/563.1 |

FOREIGN PATENT DOCUMENTS

| | | |
|---|---|---|
| 744 155 | 2/1956 | (GB) . |
| 2 243 873 | 11/1991 | (GB) . |
| 2 283 283 | 5/1995 | (GB) . |

* cited by examiner

*Primary Examiner*—Robert M. Fetsuga
(74) *Attorney, Agent, or Firm*—Connolly, Bove, Lodge & Hutz

(57) ABSTRACT

An hydraulic bath seat lift has a hydraulic cylinder assembly comprising an inner cylinder fixed with the floor and an outer cylinder, which can be raised and lowered by supplying hydraulic fluid to the assembly. The outer cylinder supports a seat at the end of a horizontal arm. The inner cylinder has a pin at its upper end projecting outwardly into one of two sets of longitudinal grooves along the inner surface of the outer cylinder to prevent the outer cylinder rotating relative to the inner cylinder. The grooves open into one another at the lower end of the outer cylinder so that when the outer cylinder is raised fully, to lift the seat above the bath, the cylinder can be rotated to swing the seat over the bath and then lowered with the pin engaging the other set of grooves.

13 Claims, 2 Drawing Sheets

HYDRAULIC LIFT CYLINDER ASSEMBLIES

BACKGROUND OF THE INVENTION

This invention relates to hydraulic lift cylinder assemblies.

Hydraulic lift cylinder assemblies are used in various applications, such as in bath seat lifts where the seat can be raised from a position outside the bath, swung over the bath and lowered into the bath. One cylinder that can be used in such an application is described in GB2274323. It is important that cylinders used in such applications cannot be lowered in the incorrect position because this could increase the risk of a part of the user's body being trapped, such as between the seat and the rim of the bath.

BRIEF SUMMARY OF THE INVENTION

It is an object of the present invention to provide an hydraulic lift cylinder assembly.

According to one aspect of the present invention there is provided an hydraulic lift cylinder assembly including an inner cylinder and an outer cylinder arranged telescopically with one another such that the two cylinders can be extended and retracted by supplying hydraulic fluid between the cylinders, the inner surface of the outer cylinder and the outer surface of the inner cylinder being provided with a longitudinally-extending track and a cooperating engaging member such that rotation between the two cylinders is prevented along at least a part of the extension of the two cylinders.

The track is preferably on the inner surface of the outer cylinder and the cooperating engaging member is preferably on the outer surface of the inner cylinder. The track may be a groove and the engaging member a projecting pin. The track preferably opens towards the end of extension of the two cylinders so as to permit relative rotation between the two cylinders when extended. The assembly may include two tracks at different orientations so that the two cylinders can be extended and retracted along different tracks. The inner cylinder may be fixed at one end and the assembly extended by displacing the outer cylinder. The outer cylinder may have a sliding seal at its lower end that slides along and seals with the outer surface of the inner cylinder. The assembly preferably includes a sliding bearing towards the upper end of the assembly engaging the outer surface of the outer cylinder, the sliding bearing may be supported towards the upper end of an outer sleeve extending around the outer cylinder and fixed at its lower end.

According to another aspect of the present invention there is provided a bath seat lift including an assembly according to the above one aspect of the invention and a seat supported by the assembly, the assembly being operable to lit the seat from a position outside a bath, to enable the seat to be swung over the bath, and to lower the seat into the bath.

A bath seat lift including a cylinder assembly according to the present invention, will now be described, by way of example, with reference to the accompanying drawings.

DETAILED DESCRIPTION OF THE PREFERRED EMBODIMENT

Figure 1:
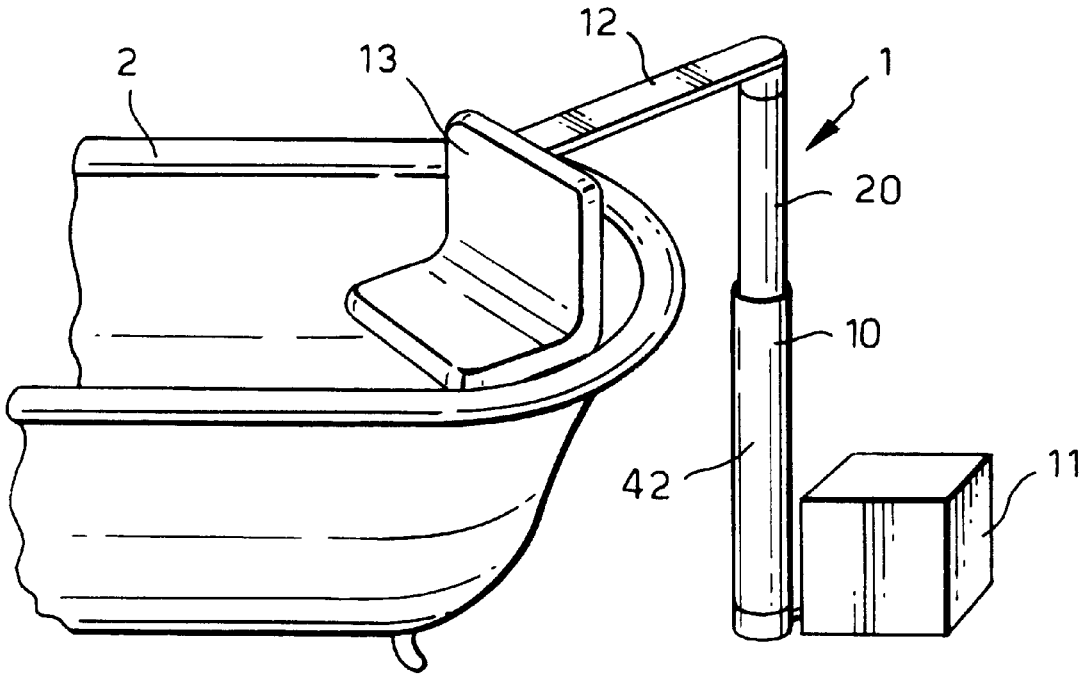
FIG. 1 is a perspective view of the seat lift with the cylinder assembly extended.

With reference first to FIG. 1, the seat lift assembly is indicated generally by the numeral 1 and is shown mounted on the floor outside a bath 2. The seat lift assembly 1 includes an hydraulic cylinder assembly 10 connected at its lower end to a supply and control unit 11. The upper end of the cylinder assembly 10 supports one end of a horizontal arm 12, the other end of which supports a bath seat 13. The seat lift assembly 1 can raise the bath seat 13 from a position outside the bath 2 to its upper extent where the seat can be swung through 90° to a position above the bath. The seat 13 can then be lowered vertically into the bath. The construction of the cylinder assembly 10 ensures that the seat 13 can only be swung about the axis of the cylinder assembly when it is fully extended and that it can only be lowered in certain positions.

Figure 2:
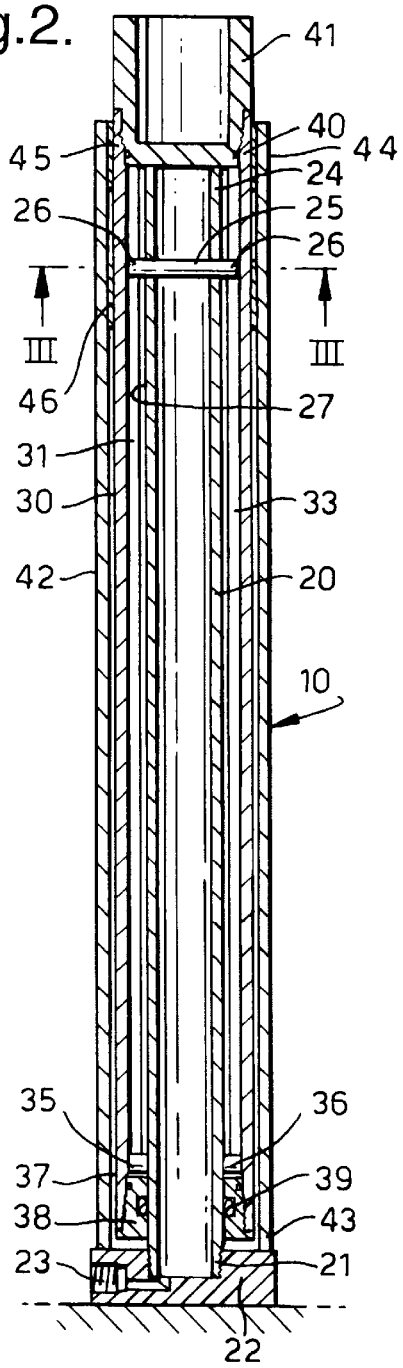
FIG. 2 is a cross-sectional side elevation view of the cylinder assembly retracted.
Figure 3:
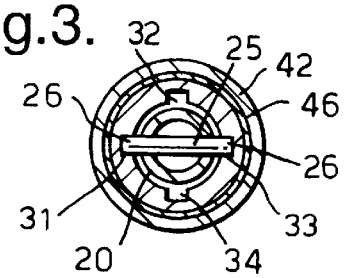
FIG. 3 is a cross-sectional transverse view of the assembly along the line III—III of FIG. 2.
Figure 5:
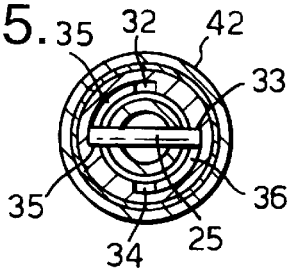
FIG. 5 is a cross-sectional transverse view along the line V—V of FIG. 4.

Referring now also to FIGS. 2 and 3, the cylinder assembly 10 has an inner, vertical cylinder 20 of circular section and made of a metal such as hard anodized aluminum. The inner cylinder 20 is hollow and its lower end 21 is fixed to a floor-mounted mounting block 22. A port 23 opens through the mounting block 22 into the inside of the cylinder 20, the port communicating outside the cylinder assembly 10 with the supply unit 11. A short distance below its upper end 24, the inner cylinder carries a radial pin 25, which extends diametrically of the cylinder and projects at opposite ends 26 a short distance beyond the outer surface 27 of the inner cylinder. The upper end 24 of the inner cylinder 20 is open.

An outer cylinder 30 of approximately the same length extends coaxially along the outside of the inner cylinder 20. The outer cylinder 30 is made of hard anodized extruded aluminum and has four tracks or grooves 31 to 34 extruded along its length on its inner surface. The grooves 31 to 34 extend parallel to one another and are spaced from one another by 90° around the inside of the cylinder 30. The grooves 31 to 34 terminate a short distance above the lower end of the cylinder 30 where they open into two arc-shape recesses 35 and 36. One recess 35 extends between the grooves 31 and 32; the other recess 36 extends between the grooves 33 and 34. The lower end 37 of the outer cylinder 30 is closed by a metal collet 38 carrying a sliding seal 39, which bears against the outer surface 27 of the inner cylinder 20. The upper end 40 of the outer cylinder 30 is closed by a seat mounting cup 41 in which the inner end of the arm 12 is fixed.

The cylinder assembly 10 is completed by an outer metal sleeve 42, which is fixed at its lower end 43 to the mounting block 22 and extends coaxially around the outer cylinder 30. Towards its upper end 44, the outer sleeve 42 has two plain sliding bearings 45 and 46, which bear against the outside of the outer cylinder 30 to provide support for the outer cylinder against lateral forces.

Operation of the seat lift assembly 1 will now be described, assuming that the seat 13 is in its lowest position outside the bath 2. In this position, the cylinder assembly 10 is fully retracted, as shown in FIG. 2, with the collet 38 of the outer cylinder 30 resting on the inside of the mounting block 22 and with the seat mounting cup 41 just protruding from the upper end 44 of the outer sleeve 42. The ends 26 of the pin 25 on the inner cylinder 20 project into the grooves 31 and 33 in the outer cylinder 30 close to its upper end. In this way, the outer cylinder 30 cannot rotate with respect to the inner cylinder 20 and, because the inner cylinder is fixed at its lower end, cannot rotate with respect to the assembly 10 as a whole.

Figure 4:
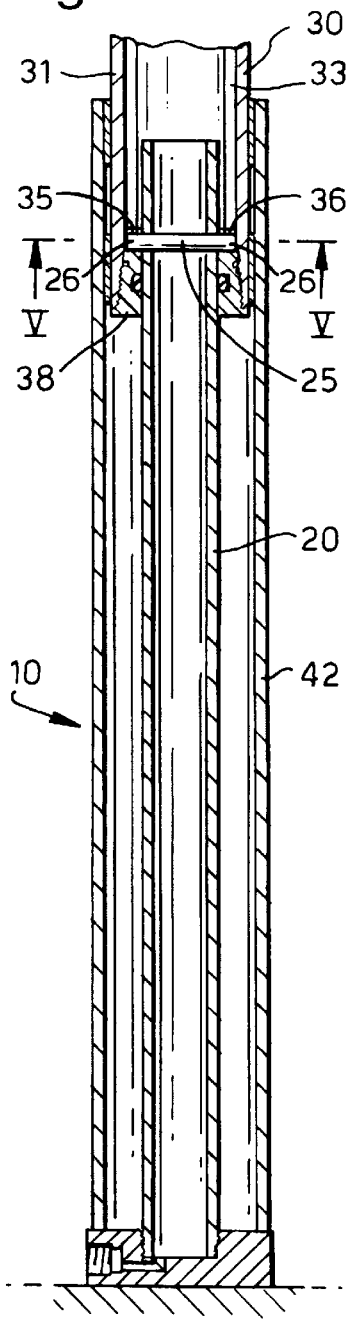
FIG. 4 is a cross-sectional side elevation view of the lower part of the cylinder assembly filly extended.

To lift the user into the bath 2, the supply unit 11 is switched to its RAISE mode and hydraulic fluid is pumped into the inner cylinder 20 via the port 23. As fluid enters the inner cylinder 20, it expands the volume between the inner cylinder and the inside of the outer cylinder 30 by raising the outer cylinder and hence the seat 13. Hydraulic fluid is prevented from escaping from the outer cylinder 30 by the sliding seal 39 at its lower end 37. The sliding bearings 45 and 46 on the outer sleeve 42 serve a mechanical purpose of preventing lateral movement of the outer cylinder 30. Rotation of the outer cylinder 30 is prevented at all heights by the sliding engagement of the ends 26 of the pin 25 in one set of opposite grooves 31 and 33 until the outer cylinder reaches its upper limit of travel, as shown in FIG. 4. In this position, the ends 26 of the pin 25 are clear of the lower end of the grooves 31 and 33 and locate in the arc-shape recesses 35 and 36 respectively. At this upper limit of travel, the seat 13 is higher than the rim of the bath 2. The seat 13 is swung about the vertical axis of the cylinder assembly 10 through 90°, as limited by the extent of the recesses 35 and 36 in which the ends 26 of the pin 25 can move laterally, so that the seat is located directly above the bath 2. The ends 26 of the pin 25 are now in alignment with the other set of two grooves 32 and 34 in the outer cylinder 30 so that the seat 13 can be lowered into the bath 2 by switching the supply unit 11 to its LOWER mode, in which hydraulic fluid is allowed to flow out of the cylinder assembly 10 under force applied by the weight of the seat and the user. Alternatively, a pump in the supply unit 11 could be reversed to pump fluid out of the cylinder assembly 10.

The user is lifted out of the bath 2 by raising the cylinder assembly 10, swinging the seat 13 out and then lowering the seat outside the bath.

The present invention ensures that the outer cylinder can only be rotated relative to the inner cylinder when fully extended and that the cylinder can only be retracted when correctly aligned above or outside the bath. This helps reduce the risk that the seat could be lowered in such a way as to trap a part of the body between the seat and the rim of the bath.

It will be appreciated that the two sets of grooves need not be displaced from one another by 90° but could have different relative positions according to the application to which the cylinder assembly is being put. The extent of axial movement could be arranged to be different in the different orientations of the two cylinders so that, for example, with a bath seat, it could be arranged so that it could only be lowered a smaller distance outside the bath than inside the bath. Instead of grooves, some other form of elongate track, such as a projecting rail could be used engaged by appropriately-shaped engaging member. The groove or track could be on the outside of the inner cylinder instead of on the inside of the outer cylinder. The invention could be used in various other applications where it is important to prevent relative rotation between the two cylinders.

What I claim is:

1. An hydraulic lift cylinder assembly comprising: an inner cylinder; an outer cylinder, said outer cylinder being mounted telescopically with said inner cylinder; a supply of hydraulic fluid connected to supply hydraulic two cylinders such that they can be extended and retracted; and a longitudinally-extending track and a cooperating engaging member on said inner and outer cylinders such that rotation between said two cylinders is prevented along at least a part of the extension of said two cylinders.

2. An assembly according to claim 1, wherein said track is on an inner surface of said outer cylinder and said cooperating engaging member is on an outer surface of said inner cylinder.

3. An assembly according to claim 1, wherein said track is a groove.

4. An assembly according to claim 1, wherein said engaging member is a projecting pin.

5. An assembly according to claim 1, wherein said track opens towards an end of extension of said two cylinders so as to permit relative rotation between said two cylinders when extended.

6. An assembly according to claim 1 including two said tracks at different orientations so that said two cylinders can be extended and retracted along different tracks.

7. An assembly according to claim 1, wherein said inner cylinder is fixed at one end and the assembly is extended by displacing said outer cylinder.

8. An assembly according to claim 7, wherein said outer cylinder has a sliding seal at its lower end that slides along and seals with an outer surface of said inner cylinder.

9. An assembly according to claim 7 including a sliding bearing towards an upper end of the assembly engaging an outer surface of said outer cylinder.

10. An assembly according to claim 9 including an outer sleeve extending around said outer cylinder and fixed at a lower end, and wherein said sliding bearing is supported towards an upper end of said outer sleeve.

11. An hydraulic lift cylinder assembly comprising: an inner cylinder; an outer cylinder, said outer cylinder being mounted telescopically with said inner cylinder; a supply of hydraulic fluid connected to supply hydraulic fluid between the two cylinders such that they can be extended and retracted; two longitudinally-extending grooves on an inner surface of said outer cylinder; and a cooperating engaging member projecting from said inner cylinder into a said groove such that rotation between said two cylinders is prevented along the length of said grooves, and wherein said two grooves connect with one another at one end of said outer cylinder such that said engaging member can be moved between the two grooves and said outer cylinder rotated relative to said inner cylinder when the two cylinders are extended.

12. An hydraulic lift cylinder assembly comprising: an inner cylinder, said inner cylinder being fixed at its lower end; an outer cylinder, said outer cylinder being mounted telescopically with said inner cylinder; a supply of hydraulic fluid connected to supply hydraulic fluid between the two cylinders such that said outer cylinder can be raised and lowered relative to said inner cylinder; a longitudinally-extending track and a cooperating engaging member on said inner and outer cylinders such that rotation between said two cylinders is prevented along at least a part of the extension of said two cylinders; an outer sleeve extending around said outer cylinder and fixed at its lower end; and a sliding bearing mounted in said outer sleeve towards its upper end to engage an outer surface of said outer cylinder and to provide lateral support therefor.

13. An hydraulic bath seat lift comprising: a fixed cylinder; a movable cylinder, said movable cylinder being mounted telescopically with said fixed cylinder; a supply of hydraulic fluid connected to supply hydraulic fluid between the two cylinders such that said movable cylinder can be raised and lowered; a longitudinally-extending track and a cooperating engaging member on said fixed and movable cylinders such that rotation between said two cylinders is prevented along at least a part of the extension of said two cylinders; and a seat, said seat being mounted on an arm extending laterally from said movable cylinder such that said seat can be positioned outside a bath and raised without rotation to an upper position where said seat is positioned above the height of said bath and where the movable cylinder can be rotated to swing said seat over the bath enabling said seat to be lowered into the bath.

* * * * *